United States Patent [19]

Yoerger

[11] Patent Number: 5,034,297

[45] Date of Patent: Jul. 23, 1991

[54] BOUND METAL ALKOXIDE COATED TONER PARTICLES

[75] Inventor: William E. Yoerger, Rochester, N.Y.

[73] Assignee: Eastman Kodak Company, Rochester, N.Y.

[21] Appl. No.: 418,598

[22] Filed: Oct. 10, 1989

[51] Int. Cl.[5] ..... G03G 9/08

[52] U.S. Cl. ..... 430/109; 430/110; 430/137

[58] Field of Search ..... 430/110, 109, 137

[56] References Cited

U.S. PATENT DOCUMENTS

| | | | |
|---|---|---|---|
| 4,404,270 | 9/1983 | Higashida et al. | 430/110 |
| 4,409,312 | 10/1983 | Ikeda et al. | 430/110 |
| 4,443,614 | 4/1984 | Kondo et al. | 548/469 |
| 4,450,221 | 5/1984 | Terada et al. | 430/106.6 |
| 4,600,676 | 7/1986 | Terada et al. | 430/106.6 |

FOREIGN PATENT DOCUMENTS

| | | |
|---|---|---|
| 58-082254 | 5/1983 | Japan . |
| 58-158650 | 9/1983 | Japan . |
| 59-029258 | 2/1984 | Japan . |
| 59-223449 | 12/1984 | Japan . |
| 60-052850 | 3/1985 | Japan . |
| 61-057663 | 3/1986 | Japan . |

*Primary Examiner*—John Goodrow

*Attorney, Agent, or Firm*—Dressler, Goldsmith, Shore, Sutker & Milnamow, Ltd.

[57] ABSTRACT

A toner powder composition is provided wherein the toner particles are coated with a metal alkoxide. The product powder displays improved flow characteristics. The coating is accomplished by contacting starting toner particles with a solution of metal alkoxide in a solvent wherein the toner particles are substantially completely insoluble, followed by separation and drying. The metal of the alkoxide has a valence of 3 through 5, and the alkoxy groups contain not more than 10 carbon atoms.

17 Claims, No Drawings

BOUND METAL ALKOXIDE COATED TONER PARTICLES

FIELD OF THE INVENTION

This invention lies in the field of metal oxide coated toner particles and processes for making the same.

BACKGROUND OF THE INVENTION

Titanium and aluminum alkoxides have been incorporated into toner particles; see, for example, U.S. Pat. Nos. 4,409,312; 4,600,676; 4,450,221; and Jap. Pat. Publication Nos. 59029258-A and 58158650-A. Substances such as dibutyl tin oxide have also been similarly incorporated into toner particles; see, for example, U.S. Pat. No. 4,404,270.

So far as is now known, however, no one has heretofore coated toner particles having reactive functional groups with metal alkoxides using only a solvent carrier to produce toner powders with improved flow characteristics.

BRIEF SUMMARY OF THE INVENTION

This invention relates to toner particles which are coated with metal alkoxides that have reacted with functional groups present on surface portions of the toner particles, and to processes for producing the same.

The coated toner particles of the present invention display improved flow characteristics.

The starting toner particles are comprised of polymers, and such toner particles are known to the art generally and are characterized by a low glass transition temperature ($T_g$), a low to moderate fusing temperature, and a suitable size in the micron range. Also, the starting toner particles have at least one type of functional group located in particle surface portions. Such a functional group is associated with the toner polymer backbone structure, and such a group is reactive with metal alkoxides under the conditions employed for particle treatment. Examples of such functional groups include hydroxyl, amino, amido, thio and carboxyl groups.

The starting metal alkoxides are likewise known to the art. The metal thereof has a valence in the range of 2 through 5, and the alkoxy portions thereof contain less than 10 carbon atoms each.

Various advantages, aims, features, purposes, embodiments and the like for the present invention will be apparent to those skilled in the art from the present specification taken with the accompanying claims.

DETAILED DESCRIPTION

Starting Polymer

In general, any polymer of the type known to the art that is suitable for use in toner particles can be used as the matrix or continuous phase of toner particles used as starting materials in the practice of the present invention provided such polymer contains functional groups that are reactive with metal alkoxides.

In general, polymers employed in toner particles of this invention have glass transition temperatures ($T_g$) in the range of about 50° to about 120° C. and fusing points in the range of about 65° to about 200° C. so that toner particles can be readily fused to receiving sheets, such as paper sheets comprised of plastic, or the like. Presently preferred $T_g$'s are in the range of about 50° to about 80° C. and presently preferred fusing points are in the range of about 65° C. to about 120° C. However, polymers with higher $T_g$'s and higher fusing points can be employed when desired for particular receiving sheets, such as metal plates, or the like.

The term "fusing point" as used herein refers to the melting point of a resin as measured by a Fisher Johns apparatus, Fisher Scientific Catalog no. 12-133. The term "glass transition temperature" (or $T_9$) as used herein refers to the temperature at which a polymer material changes from a glassy polymer to a rubbery polymer. This temperature ($T_g$) can be measured by differential thermal analysis as disclosed in Techniques and Methods of Polymer Evaluation, Vol. 1 Maroel Dekker, Inc., N.Y., 1966.

In toner particles comprised of such a polymer, the particle surfaces contain or are comprised of functional groups. Examples of suitable functional groups include hydroxyl, amino (particularly primary or secondary amino groups), amido, thio, carboxyl (including ester linkages), and the like.

Preferred polymers are polyesters and polyesteramides. The polyester polymers used as the matrix phase in starting toner particles employed in the practice of this invention preferably have inherent viscosities in the range of about 0.05 to about 0.80 when measured at a concentration of about 0.25 gm/1. at 25° C. in dichloromethane.

Other suitable polymers for use in toner particles include copolymers of styrene (or styrene homologs) and a comonomer containing such a functional group, such as an acrylic monomer containing such a functional group; polycarbonates; modified alkyl resins; phenoxy; phenol-formaldehyde resins; and the like.

For example, in the case of styrene copolymers, the functional group containing acrylic monomer can be 2-hydroxyethyl methacrylate, or the like. A third non-functional group containing an acrylic monomer, such as n-butyl acrylate, or the like can also be incorporated into such a copolymer. Thus, for illustration, such a copolymer can be comprised on a 100 weight percent total polymer basis of about 40 to about 80 weight percent of styrene (or styrene homologs), about 5 to about 50 weight percent of at least one functional group containing acrylic monomer, and 0 to about 30 weight percent of at least one non-functional group containing acrylic monomer.

In general, methods for manufacturing such polymers are well known and any convenient preparation procedure can be utilized. For example, in the case of the preferred polyesters, polyester monomers are polymerized by conventional procedures. The monomers present in a polymerizable monomer mixture are usually dicarboxylic acids and diols (or their functional equivalents). Functional equivalents, for example, in the case of dicarboxylic acids include esters, anhydrides, acid halides, and the like. Examples of dicarboxylic acids (and their functional equivalents) include terephthalic acid, isophthalic acid, sulfoisophthalic acid, glutaric acid, dimethyl terephthalate, dimethyl glutarate, phthalic anhydride, and the like. Examples of suitable diols include ethylene glycol, 1,2-propane diol, neopentyl glycol, 1,4-cyclohexane-dimethanol, and the like. Also useful are polyfunctional compounds having one or more carboxyl groups and one or more hydroxyl groups per molecule. Various polyols, such as triols, tetrols, or various polyacids, can be used to create branching in the polyester chain, such as glycerol, pentaerythritol, trimethylolpropane, trimellitic anhydride, pyromellitic dianhydride, and the like. Preferably, up to about 10 mole percent of a reactable monomer mixture is comprised of a compound having three or more hydroxyl and/or carboxyl groups. Polymerization procedures are well known in the art. Branched polyester resins can be prepared, for example, by using two stage polyesterification procedures, such as described in U.S. Pat. Nos. 4,140,644 and 4,217,400 which latter is especially directed to the control of branching in polyesterification.

STARTING TONER PARTICLES

Starting toner particles can be conventionally prepared from polymers by any convenient or suitable procedure. By one procedure, a thermoplastic or thermosetting solid polymer, optionally with any desired additives, such as a colorant (dye or pigment) a charge control agent (including antiblocking agent), and/or the like, is melt blended on heated compounding rolls until a uniform composition is obtained wherein the polymer comprises at least about 50 weight percent, and preferably about 75 to about 98 weight percent, of a product composition with the balance up to 100 weight percent thereof being such additives. The concentration of colorant can range between about 0.5 to about 20 weight percent, more preferably about 1 to about 6 weight percent, and the amount of charge control agent, can range between about 0.05 to about 5 weight percent, more preferably about 0.3 and about 2.0 weight percent.

Examples of useful charge control agents are disclosed in U.S. Pat. Nos. 3,893,935; 4,079,014; and 4,323,634; and in British Patent Nos. 1,501,065 and 1,420,839. Quaternary ammonium salt charge agents are disclosed in "Research Disclosure No. 21,030" Volume 210, October, 1981 (published by Industrial Opportunities Ltd., Homerwell, Havant, Hampshire, P09 1EF, United Kingdom.

Examples of suitable colorants are disclosed in U.S. Pat. Nos. 4,140,644; 4,416,965; 4,414,152; and 2,229,513. For black toners, carbon black is a preferred pigment. The toner is crushed and ground to a desired particle size using, for example, fluid energy or a jet mill such as is described in U.S. Pat. No. 4,089,472.

Other procedures for the preparation of toner particles are also taught. For example, European Patent Application No. 0,003,905, filed Feb. 21, 1979, teaches a two step procedure wherein monomers are diffused into polymers and then polymerized. Spherical particles having a mean size of about 1 to about 4 micrometers are produced. Dyes may be incorporated into the particles by adding them simultaneously with the formation of the polymers or subsequently thereto.

For another example, "Research Disclosure Item 15963" published July, 1972 describes a continuous emulsion polymerization procedure from which toner particles are isolated.

For another example, a polymer solution in a solvent in combination with colorants and/or charge control agents can be spray dried to form toner particles.

One or more conventional particle classification steps can be used to achieve a toner particle composition having a particle distribution within a specified or desired range.

The particle size of starting toner particles used in the practice of this invention is typically in the range of about 0.01 to about 100 microns in average diameter. Since commercially used contemporary copying machines commonly employ toner particles in the size range of about 1 to about 30 microns in average diameter, such particles sizes are presently preferred. Toner powders of about 0.01 micron in average diameter are suitable for use in the powder cloud development process. Larger sized toner particles are useful in various methods of dry development such as cascade development, magnetic brush development, and the like.

METAL ALKOXIDES

Metal alkoxides used in the practice of this invention are reactive with the functional groups (above described) that are present in a starting polymer. The metal alkoxide need have no special properties or structure; however, it is presently contemplated that the metal in such an alkoxide molecule have a valence in the range of 2 through 5 and that each alkoxy group in such molecule contains not more than 10 carbon atoms.

Presently preferred metals are selected from Groups IIA, IIIA, IIIB, IVA, IVB, VA, and VB of the Periodic Table of the Elements. Examples are shown in Table I below:

TABLE I

| Ex. | Examples of Metals and their Groups | | | |
|---|---|---|---|---|
| | Periodic Table of the Elements | | Metal | |
| No. | Group No. | Atomic no | Name | Symbol |
| 1 | IIA | 12 | magnesium | Mg |
| 2 | IIA | 20 | calcium | Ca |
| 3 | IIIA | 13 | aluminum | Al |
| 4 | IIIB | 57 | lanthanum | La |
| 5 | IVA | 32 | germanium | Ge |
| 6 | IVA | 50 | tin | Sn |
| 7 | IVB | 22 | titanium | Ti |
| 8 | IVB | 40 | zirconium | Zn |
| 9 | VA | 51 | antimony | Sb |
| 10 | VB | 73 | tantalum | Ta |

A presently preferred metal is titanium and presently preferred alkoxy groups contain not more than four carbon atoms each.

Metal alkoxides are known and many are commercially available.

SOLVENT

The starting metal alkoxide is dissolved in a solvent in which the starting toner particles are substantially completely insoluble.

The term "substantially completely insoluble" as used herein means that a starting toner powder is at least about 99.5 weight percent insoluble in a given solvent and preferably is at least about 99.9 weight percent insoluble in a given solvent.

A solvent is also chosen which is substantially completely evaporatable at a temperature not higher than about 50° C. so as to permit separation of residual amounts of such solvent from toner particles contacted therewith.

The term "substantially completely evaporatable" as used herein means that a toner composition of this invention which has been treated with metal alkoxide as taught herein can contain not more than about 0.5 weight percent of such solvent, and preferably not more than about 0.05 weight percent of such solvent after being exposed to temperatures below about 50° C. (with or without the use of subatmospheric pressure).

Examples of suitable solvents include alkanes, such as hexane, octane, and heptane; Isopar G TM (a brand of high-purity mixed isoparaffinic materials marketed by Exxon Corp.); ligroin (a saturated, volatile fraction of petroleum boiling in the range of about 20 to about 135° C. based on the ASTM definition); halogenated hydrocarbons, such as trifluoromethane and trifluorotrichloroethane; cyclic hydrocarbons, such as cyclohexane; odorless mineral spirits; and the like.

Mixtures of different solvents can be employed in a given solvent medium. For example, a small amount (up to about 15 weight percent on a total solvent composition basis) of an alcohol, such as an alkanol, like ethanol, or the like, may be desirable for use in combination with an alkane, such as heptane or the like, in order to dissolve a starting metal alkoxide.

PROCESS OF PREPARATION

The toner particle compositions of this invention are prepared by a process comprising the steps of:

(a) coating toner particles with a solution of metal alkoxide in a solvent in which the toner particles are substantially completely insoluble;

(b) separating the coated toner particles from such solution; and (c) heating or drying the coated toner particles to a temperature not higher than about 50° C.

The toner particles, the metal alkoxide, and the solvent are as above characterized.

The coating is preferably accomplished by immersing or otherwise contacting the starting toner particles in the metal alkoxide solution, and stirring or otherwise gently agitating the resulting mixture. Contacting times can vary greatly, but are typically in the range of about 10 to about 90 minutes, and preferably are in the range of about 30 to about 45 minutes.

Typically, the concentration of metal alkoxide dissolved in the solvent at the start of the coating step is in the range of about 0.002 to about 0.012 moles metal alkoxide per liter of solvent, although larger and smaller concentrations can be used. Also typically, the quantity of toner particles introduced, or immersed into such a solution, is in the range of about 400 to about 670 grams per liter of the alkoxide solution, although larger and smaller amounts can be used.

The resulting coated toner particles are separated from the residual solution of metal alkoxide by any convenient procedure, such as settling, decantation, filtration, centrifuging, or the like.

The particle drying or heating can be accomplished by air exposure, flowing ambient temperature air, flowing heated air having a temperature up to about 45° C., or the like, as desired. Reduced pressures (vacuum) may be employed to accelerate drying. Drying is continued until the level of solvent in the product is below about 0.5 weight percent based on total toner product composition weight, and preferably below about 0.1 weight percent.

After drying (or heating) a product may be passed through a sieve, or the like, if desired, to break up or separate clumps caused by the separation procedure.

Various additives, such as charge agents, poly dimethyl siloxanes and the like, may be present in the solvent medium at the time of the coating.

A solution can be reused, if desired, by maintaining the concentrations of metal alkoxide within the range above indicated. Coating can be accomplished continuously, if desired.

Apart from the solvent coating procedure described herein, a starting toner powder can be surface treated with metal alkoxide by vaporizing the metal alkoxide and depositing the metal alkoxide upon toner particle surfaces using temperatures which do not exceed the $T_g$ of the toner powder.

TONER COMPOSITIONS

Toner particles as above characterized herein which are individually coated with a layer of metal alkoxide wherein the metal alkoxide has been reacted with at least a portion of the functional groups (above indicated) present in toner particle surfaces comprise the toner compositions of this invention.

In such a composition, the particle size range is comparable to that of the integrating toner particles since only a thin layer of metal alkoxide becomes associated with, and bound to, particle surfaces. Preferably, the weight ratio of toner particles (conveniently on an untreated weight basis or equivalent) to metal alkoxide in a product composition is in the range of about 1000:1 to about 100:1, and more preferably about 400:1 to about 200:1.

Toner compositions of the present invention are generally characterized by improved flow properties compared to the untreated toner particles.

In order to achieve such improved characteristics, it now appears to be necessary for the toner particles to react with metal alkoxide using a treating procedure such as taught herein. If no reaction occurs between the metal alkoxide and the toner particle surfaces, then no improvement in toner particle flow properties is observed. For example, titanate alkoxides were found to be effective for achieving improved flow properties only when coated upon toner powders, such as those comprised of polyester and/or polyesteramide polymers where such titanates could react with hydroxyl, carboxyl, or amido groups present in these polymers.

Attempts to add such titanates directly into the toner during the compounding thereof produced no noticeable increase in the flow properties of the final polyester or polyesteramide toner, however, an increase in melt viscosity was observed, possibly due to crosslinking. Similarly no change in flow characteristics was observed with toners comprised of styrene-acrylic type copolymers unless such copolymers were polymerized with monomers which resulted in reaction groups being present, such as in a copolymer of styrene with hydroxyethylmethacrylate.

It is theorized (and there is no intent to be bound herein by theory) that product toner compositions may have at least some polymerization of metal alkoxide molecules to one another along or on toner polymer particle surfaces in addition to reaction of metal alkoxides with functional groups on toner polymer particle surfaces. Oxy(—0—) is perhaps a typical linking group.

Non-metal alkoxides, such as Si, B, P, and C alkoxides, exemplified by silicon tetra alkoxide and the like, were found to produce little or no effect as a toner surface treatment agent. It is theorized that such alkoxides may be too stable or too unreactive with particle surface functional groups to form particle surface layers under the present surface treating conditions.

In one preferred mode of practicing the present invention, a polymeric charge agent is added to the solvent medium during the coating procedure to adjust the final charge of the treated toner particles to a desired level.

If desired, a toner composition can be compounded with additives. For example, small amounts (typically less than about 4 weight percent on a 100 weight percent total product basis) of a high molecular weight liquid polydimethylsiloxane or other low surface energy liquid can be admixed with a toner composition of the present invention to lower the cohesive particle-to-particle strength thereby aiding in the reduction of toner "flakes". Also, toner compositions of this invention may contain conventional other additives, such as plasticizers, waxes, dispersants, flow agents (such as silica, calcium carbonate, etc.), colorants (black pigment, colored dye or pigment, such as red, blue, green, cyan, magenta, yellow, etc.), and the like.

The following examples further illustrate the present invention.

EXAMPLES 1.1–1.5

Preparation of Toner Compositions

A 10.0 g sample of a magenta polyester toner powder was stirred for 30 to 45 minutes at room temperature in 25 mL of a liquid which was a non-solvent (e.g., hexane) for the toner, but which was a solvent for about 0.25 to 1.0 percent of an organic titanate alkoxide (based on the weight of toner) that was dissolved therein. This alkoxide was tetrabutylorthotitanate. The toner slurry was then filtered and dried in air or a slight vacuum at about 45° C. and then sieved to break up clumps caused by the filtration process. The toner was mixed for 3 minutes at a 13 percent toner concentration on a hard ferrite carrier coated with 1 pph of Kynar 301F TM which is a brand of polyvinylidine fluoride marketed by Penwalt. The resultant developer was magnetized and the toner blow-off charge and throw-off measurements made on a conventional rotating magnetic brush using a standard toner blow-off method. The fresh and five minute exercised charge was measured on a 0.1 g sample for 30 seconds at 2000 V to yield the data shown in the following Table II:

TABLE II

| Ex. No. | Treatment | Blow Off Charge (μ/g) | Throw-off[1] (mg) | Fresh Charge[2] | 5 Minute Exercised Charge |
|---|---|---|---|---|---|
| 1.1 | Control | 19.7 | 0.5 | 63.5 | 22.7 |
| 1.2 | Control + 1% tetrabutyl-orthotitanate | 4.8 | 2.4 | 9.4 | 5.5 |
| 1.3 | Control + 0.5% tetrabutyl-orthotitanate | 8.4 | 3.3 | 27.4 | 12.3 |
| 1.4 | Control + 0.5% tetrabutyl-orthotitanate + 0.5% polymeric charge agent[3] | 14.5 | 0.4 | 55.5 | 19.0 |
| 1.5 | Control + 0.25% tetrabutyl-orthotitanate | 12.2 | 1.5 | 37.5 | 14.4 |

Table II footnotes:

[1]Throw-Off Measurement Technique (1) 4.0 g of developer in a 4 dram vial are put into a recipratory shaker for 0.5–2 minutes (2) The mixed developer is placed on a magnetic brush roller. The brush is not activated to prevent losing initial developer throw-off.

(3) Weigh fiberglass depth filter paper (Reeve Angle 934AH) to 4 decimal places, place filter paper in throwoff funnel and connect vacuum hose to the neck of the funnel.

(4) Invert the funnel and place it over the magnetic brush which is then turned on for one minute. The filter is then removed and a magnet is passed over it to remove all of the carrier.

(5) The filter is then weighed and the difference in weight from the original is reported as throwoff in mg.

[2]Fresh and 5 Minute Exercised Charge

The separation of toner and carrier is accomplished through the combined action of magnetic agitation of the developer and electric field. The developer is charged by shaking it in a mechanical shaker for 150 seconds and from 0 to 0.3 g are placed in a sample dish. An alternating magnetic field (60 Hz) and an electric field of 2000 V/cm are then applied for 30 sec. Toner is released from the carrier by the mechanical agitation of the developer caused by the magnetic field and transported to the upper plate by the electric field. The charge on the toner collected on the plate is determined. Toner charge-to-mass ratio is calculated by dividing the charge by the mass of the toner.

[3]p-t-butylstyrene-N-methylacryoxyethyl-N,N,N-tri-methylammonium-p-toluenesulfonate 98/2.

All of the treated toners were noted to exhibit better flow properties than the control developer, which was rated to have poor flow properties. The above quantitative data indicates that the high levels of titanate alkoxide significantly lower the developer charge and increases the throwoff level; the addition of the polymeric charge agent serves to raise the charge level, and decrease the throwoff level, of the toner. No detectable change in particle size was noted in the above treatments.

EXAMPLE 2

Preparation of Toner Composition

A polyesteramide based toner powder is substituted in place of the polyester of Example 1.4 in the procedure of Example 1.4.

The treated toner powder displayed significantly improved flow properties compared to the untreated starting toner powder.

EXAMPLE 3

Preparation of Control Toner Composition

A styrene-butylacrylate based toner powder commercially available from Eastman Kodak Company is employed in place of the polyester of Example 1.4 in the procedure of Example 1.4.

The treated toner powder displayed no change in flow characteristics compared to the untreated starting toner powder.

EXAMPLE 4

Preparation of Toner Composition.

A styrene-butylacrylate-2-hydroxyethylmethacrylate polymer 47%/23%/30% is prepared via emulsion polymerization and then compounded into a black toner formulation and ground into a toner powder. This polymer incorporated an active functional group (2-hydroxy-ethyl methacrylate) which was reactable with a titanate alkoxide.

The procedure of Example 1.4 above was repeated using such toner powder.

The treated toner powder displayed significantly improved flow characteristics compared to the untreated starting toner powder which exhibited poor flow characteristics.

EXAMPLES 5.1–5.11

Preparation of Toner Compositions

These examples demonstrate that a large variety of metal alkoxides are useful in improving the flow characteristics of polyester-based toners.

10.0 g of the same polyester toner used in Examples 1.1–1.4 was treated as in Example 1 with 0.5 weight percent of the test metal alkoxide and 0.5 weight percent of the polymeric charge agent p-t-butyl styrene-N-methacryloxyethyl-N,N,N-trimethylammonium-p-toluene sulfonate (98/2). A small amount (1–4%) of ethanol or butanol may be necessary to help dissolve the alkoxide in the heptane treating solution. Charge and throw-off measurements were made as described in Example 1; flow was measured by placing a 2.0 g sample of toner into a glass funnel with a taper of about 60° and a 6 mm I.D. stem, ½ inch long. The number of carefully controlled "taps" used along the side of the funnel with a metal spatula to cause all of the toner to completely flow and free itself from the funnel walls and to break-up any "bridging" in the stem was recorded. Toner flow was inversely proportional to the number of taps used in the experiment. Toner flow could, of course, also be regulated by changing the diameter of the funnel stem; the narrower the stem, the higher its propensity for production of toner bridging or plugging. The data shown in the following Table III was obtained. The charge and throwoff measurements were accomplished using the same procedures as described in Examples 1.1–1.4.

TABLE III

Comparative Properties of Various Metal Alkoxides

| Ex. I.D. No. | Treatment[1] | Fresh Charge | 5 Min. Exercised Charge | Blow Off Charge (μc/g) | Throwoff (mg) | Flow[2] |
|---|---|---|---|---|---|---|
| 5.1 | Control none | 67.4 | 24.6 | 19.8 | 0.8 | 57 |
| 5.2 | $Ti(OC_4H_9)_4$ | 53.2 | 19.2 | 15.2 | 0.2 | 2→3 |
| 5.3 | $Al(OC_4H_9)_3$ | 62.6 | 22.7 | 15.2 | 0.3 | 2 |
| 5.4 | $Zr(OC_3H_7)_4$ | 68.9 | 21.4 | 19.0 | 0.2 | 1 |
| 5.5 | $Sb(OC_4H_9)_3$ | 67.5 | 24.6 | 21.1 | 1.2 | 9 |
| 5.6 | $Ge(OC_2H_5)_4$ | 52.2 | 26.7 | 19.7 | 1.4 | 2 |
| 5.7 | $La(OC_3H_7)_3$ | 40.8 | 13.4 | 11.2 | 0.8 | 2 |
| 5.8 | $Ta(OC_2H_5)_5$ | 71.9 | 27.3 | 16.8 | 0.7 | 2 |
| 5.9 | $Mg(OC_2H_5)_2$ | 38.2 | 7.8 | 6.9 | 0.1 | 27 |
| 5.10 | $Sn(OC_2H_5)_2$ | 17.6 | 6.4 | 6.3 | 1.3 | 21 |
| 5.11 | $Ca(OCH_3)_2$ | 89.3 | 26.0 | 23.2 | 0.9 | 6 |

Table III footnotes:
[1]0.5 percent alkoxide + 0.5 percent polymeric charge agent, stirred 30 min in heptane and filtered.
[2]No of taps required to clear a 2.0 g sample of toner from a funnel with a 6 mm I.D. stem ½ inch long.

EXAMPLE 6

Evaluation of Flow Improvement

To evaluate whether or not toner flow improvement was due primarily to alkoxide treatment or to solvent slurry or to polymeric charge agent, the following data shown in Table IV was obtained using the same polyester toner as in Examples 1.1–1.4 (above).

TABLE IV

Evaluation of Flow Improvement

| Polyester Toner Treatment | Flow[1] |
|---|---|
| None (Control) | 60+ |
| Slurried in heptane | 60+ |
| + ½ percent tetrabutyl-ortho-titanate (TBOT) | 3 |
| + ½ percent polymeric charge agent | 60 |
| + ½ percent TBOT + ½ percent polymeric charge agent | 3 |

Table IV footnotes:
[1]Flow was determined as described previously except that, in this experiment, a funnel with a smaller diameter stem (4 mm ID) was utilized.

The data in Table IV demonstrates that the reacted, coated titanate alkoxide provided the observed improvement in flow characteristics.

EXAMPLE 7

Evaluation of Cohesive Strength

In this evaluation the effect of particle-particle cohesive strength was examined relative to its effect on toner flow properties. It was noted that if a pellet was extruded from a treated toner composition, it was difficult to break the pellet apart indicating that the cohesive strength of the toner particles was sufficient to accelerate the formation of toner flakes wherein the toner in use was pressed into a confined area.

It was further noted, however, that this cohesive strength could be significantly reduced by the addition, to the toner, of a high molecular weight polydimethylsiloxane (PDMS) gum; a hydroxy-terminated PDMS polymer; or a block copolymer containing PDMS blocks directly to the treating solution. The sample was then stirred for about 30 minutes as in Example 1 with the alkoxide and polymeric charge agent, and then the PDMS polymer, dissolved in a small amount of the same solvent, was added to the treating solution and the resulting mixture was stirred for an additional 15 min, filtered and dried. Flow measurements were made as described in Example 2 except that in this experiment a funnel with a smaller diameter stem (4 mm I.D.) was utilized on the flow funnel. The following charge results were obtained with 13 percent toner concentration on 1 pph Kynar 301F coated hard ferrite carrier.

TABLE V

Effect of Particle-Particle Cohesive Strength on Flow Characteristics

| Treatment | 30 Second CHARGE Fresh | 30 Second CHARGE 5 min Exercise | Throw-off (mg) | Toner Flow[1] |
|---|---|---|---|---|
| Control (none) | 56.9 | 19.3 | 0.2 | 60+ |
| Control[2] | 53.2 | 19.2 | 0.2 | 3 |
| Control[2] + 4 percent GE SE-30 Silicone Gum | 53.5 | 18.4 | 0.2 | 10 |
| Control[2] + ¼ percent Dow Corning 6263-60 Silicone-Polystyrene Block Copolymer (30 percent Styrene-70 percent PDMS) | 56.6 | 19.0 | 0.1 | 9 |
| Control[2] + ¼ percent PDMS END-DIOL MW = 310,00 | 54.2 | 18.2 | 0.1 | 3 |

Table V footnotes:
[1]No. of taps required to clear a 2.0 g sample of toner from a funnel with a 4 mm I.D.
[2]½ percent TBOT + ½ percent polymeric charge agent.

The foregoing specification is intended as illustrative and is not to be taken as limiting. Still other variations within the spirit and scope of the invention are possible and will readily present themselves to those skilled in the art.

I claim:

1. A toner composition comprising toner particles whose surfaces have incorporated functional groups therein having on said surfaces a layer of metal alkoxide which has been reacted with at least a portion of said functional groups.

2. The toner composition of claim 1 wherein the weight ratio of said toner particles to said metal alkoxide is in the range of about 1000:1 to about 100:1.

3. The toner composition of claim 1 wherein said functional groups are selected from the group consisting of hydroxyl, amino, amido, thio, and carboxyl groups.

4. The toner composition of claim 1 wherein the toner particles comprise a polymer that is selected from the group consisting of polyesters and polyesteramides.

5. The toner composition of claim 1 wherein the toner particles comprise a polymer that is a styrene copolymer that contains about 40 to 80 weight percent polymerized styrene, about 20 to about 60 weight percent polymerized acrylic monomer containing at least one functional group per molecule, and 0 to about 30 weight percent of polymerized acrylic monomer which is free from functional groups.

6. The toner composition of claim 1 wherein said metal alkoxide comprises a metal having a valence in the range of 2 through 5 per molecule and each alkoxy group contains not more than 10 carbon atoms.

7. The toner composition of claim 6 wherein said metal is selected from the Groups consisting of IIA, IIIA, IIIB, IVA, IVB, VA, and VB of the Periodic Table of the Elements.

8. The toner composition of claim 6 wherein said metal is selected from the group consisting of magnesium, calcium, aluminum, lanthanum, germanium, tin, zirconium, titanium, antimony, and tantalum.

9. The toner composition of claim 6 wherein said metal is titanium or aluminum.

10. The toner composition of claim 6 wherein each said alkoxy group contains not more than 4 carbon atoms.

11. The toner composition of claim 1 that further comprises a charge control agent and/or a polydimethylsiloxane.

12. A process for making a toner composition comprising the steps of sequentially:

(a) coating toner particles with a solution of metal alkoxide in a solvent, said toner particles having surfaces with incorporated functional groups, said toner particles being substantially completely insoluble in said solvent to form a layer on the surface of said particles of metal alkoxide which has been reacted with at least a portion of said functional groups;

(b) separating the coated toner particles from said solution; and (c) drying the toner particles at a temperature not higher than about 50° C. to substantially completely evaporate residual amounts of said solvent and to react said metal alkoxide with at least a portion of said functional groups.

13. The process of claim 12 wherein said functional groups are selected from the group consisting of hydroxyl, amino, amido, thio, and carboxyl groups.

14. The process of claim 12 wherein the concentration of said metal alkoxide in said solvent during said contacting is sufficient to produce a weight ratio of said toner particles to said metal alkoxide which is in the range of about 400:1 to about 200:1 after said drying.

15. The process of claim 12 wherein the toner particles comprise a polymer that is selected from the group consisting of polyesters and polyesteramides.

16. The process of claim 12 wherein said metal is titanium and said alkoxy groups each contain not more than 4 carbon atoms.

17. A toner composition comprising preformed toner particles having on the surfaces thereof a layer of a metal alkoxide layer that has reacted with at least some of the functional groups on the surface of said toner particles.

* * * * *